United States Patent [19]

Wallis

[11] Patent Number: 4,633,593

[45] Date of Patent: Jan. 6, 1987

[54] METHOD FOR THE CONTROLLED DRYING OF MATERIALS

[76] Inventor: Bruce Wallis, Thorp Arch Trading Estate, Wetherby, West Yorkshire, LS23 7BJ, England

[21] Appl. No.: 739,740

[22] Filed: May 31, 1985

Related U.S. Application Data

[63] Continuation-in-part of Ser. No. 495,374, May 17, 1983, abandoned.

[51] Int. Cl.[4] ..... F26B 3/00

[52] U.S. Cl. ..... 34/26; 34/30; 34/46; 34/48; 34/50

[58] Field of Search ..... 34/26, 30, 45, 46, 48, 34/50, 54, 76, 191

[56] References Cited

U.S. PATENT DOCUMENTS

| | | | |
|---|---|---|---|
| 1,711,574 | 5/1929 | Miller | 34/46 |
| 3,086,533 | 4/1963 | Touton | 34/30 |
| 3,380,174 | 4/1968 | McClaren | 34/26 |
| 3,434,223 | 3/1969 | Moller | 34/46 |
| 3,470,626 | 10/1969 | Pfeiffer | 34/46 |
| 4,020,562 | 5/1977 | Weyermann | 34/26 |
| 4,053,991 | 10/1977 | Steffen | 34/54 |
| 4,148,147 | 4/1979 | Steffen | 34/50 |
| 4,270,280 | 6/1981 | McClaren | 34/30 |
| 4,272,894 | 6/1981 | Salviati | 34/26 |
| 4,386,471 | 6/1983 | Bowrey et al. | 34/26 |

*Primary Examiner*—Albert J. Makay
*Assistant Examiner*—David W. Westphal
*Attorney, Agent, or Firm*—David A. Jackson

[57] ABSTRACT

A method of drying a material by passing a gas through and over the material, includes the steps of warming the material without effectively reducing the moisture content thereof by maintaining the enthalpy substantially constant and by maintaining a minimal drying potential of the gas; removing a first quantity of moisture from the material in a free drying step by increasing the drying potential from the level of the same utilized in the previous step and at least maintaining the former enthalpy level; and removing a second quantity of moisture from the material in a restrictive drying step by increasing the drying potential from the level of the same utilized in the previous step and varying the enthalpy in accordance with desired characteristics of the material.

10 Claims, 1 Drawing Figure

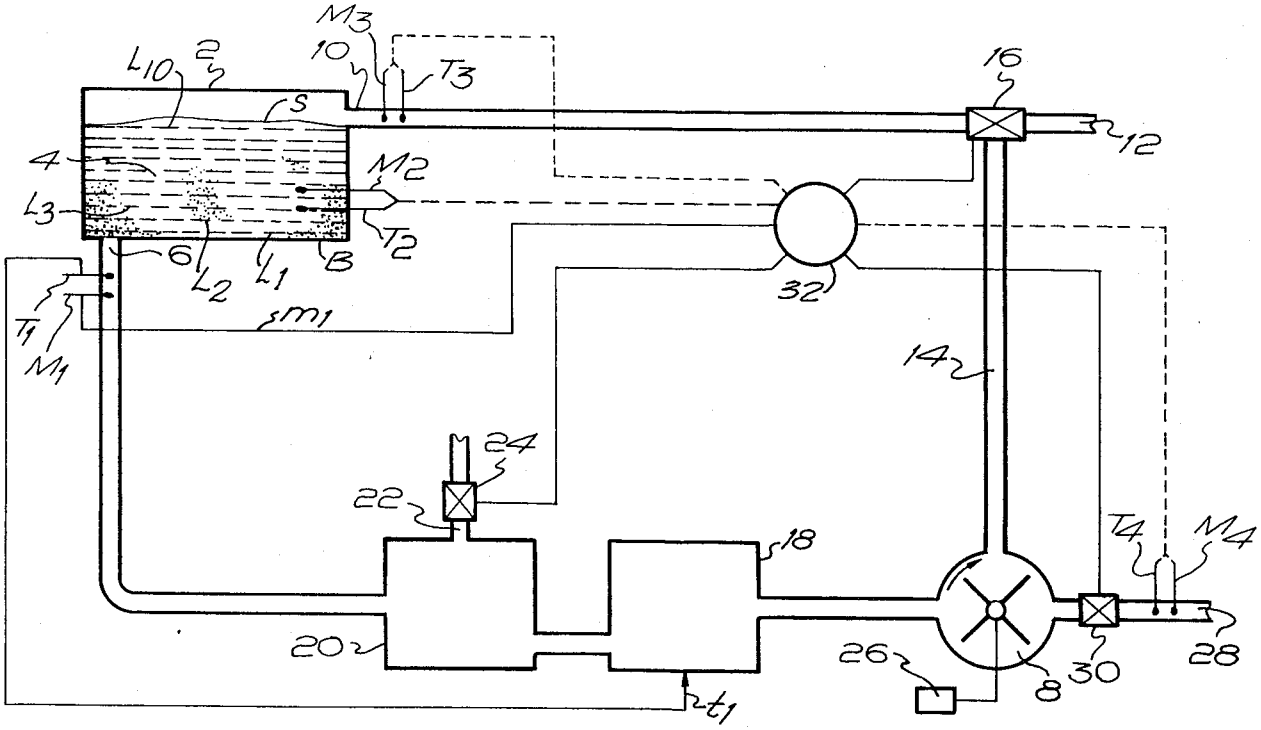
M4
28
T4
30
8
12
16
14
26
32
18
t1
24
22
20
T3
M2
T2
M3
10
S
B
L1
M1
2
L2
L10
6
4
L3
T1
M1

METHOD FOR THE CONTROLLED DRYING OF MATERIALS

REFERENCE TO RELATED APPLICATION

This application is a Continuation-In-Part of U.S. patent application Ser. No. 495,374, filed May 17, 1983, to Bruce Wallis, for "Control of Drying Operation" now abandoned.

BACKGROUND OF THE INVENTION

This invention relates generally to a method of drying materials, and more particularly, is directed to a method for the drying of a material by controlling enthalpy and drying potential of a drying gas.

The ability of relatively dry air to extract moisture from surfaces with which it makes contact is employed in a wide range of industrial and other drying operations. These operations generally use the drying potential of the air to control moisture removal. The drying potential of air is the capability of air to supply energy both to evaporate water from a system and to carry the water away, where the air is the sole means of supplying such energy. The drying potential of air is determined solely by its temperature and moisture content. For example, saturated air at 30° C. has no drying potential, while air at 75° C. and 10% humidity has a drying potential. A consideration that must be taken into account in any such system however, is that more heat must be applied to produce drier air, which thereby affects the efficiency of the operation.

However, with various materials, different problems arise with these operations where only drying potential of the air is controlled. For example, in the drying of steeped grains and the like, it is known to use plural sensors to control the moisture content and temperature of the air in a batch drying operation. The problem with such operation is that, during the drying operation, different strata or layers within the grain are dried at different rates and times. As a result, there often occurs an insufficient or excessive drying and/or caramelizing (coloring) of the grain that results in, for example, low alcohol conversion and high colors, which are undesirable.

Specifically, if the bottom stratum or layer, for example, is heated too fast, moisture in the bottom layer evaporates and travels upwardly through the grain to the next or second layer. Since the second layer is at a lower temperature at this time, the large amount of moisture from the bottom layer condenses in the second layer. As a result, the air in the second layer becomes saturated and the second layer also contains excess condensed water. Since the air in the second layer is saturated, the excess condensed water in the second layer cannot evaporate. Effectively, this is because there is a greater enthalpy in the second layer than in the next upper or third layer. As the temperature rises, the hot, wet air causes stewing of the grain, which results in low alcohol yield. With respect to green malt, for example, the low alcohol yield results in sugars being destroyed, that is, converting sugars into caramels, which is detrimental to the brewing process.

On the other hand, if drying is too slow to avoid the above disadvantage, the drying operation is inefficient. It is therefore necessary to provide an efficient drying operation without damaging the grain.

With other materials to be dried, such as paper, an uneven pick up of starch at a late stage, for example, during sizing, may result, and/or the excessive drying may adversely affect the finishing of the paper.

OBJECTS AND SUMMARY OF THE INVENTION

Accordingly, it is an object of the present invention to provide a method of optimally drying a material.

It is another object of the present invention to provide a method of drying a material without damaging the material.

It is still another object of the present invention to provide a method of drying a material by gradually raising the temperature thereof without significantly removing moisture, and then removing moisture from the material.

It is yet another object of the present invention to provide a method of drying a material by controlling the specific enthalpy of a drying gas and the drying potential thereof independent of each other.

In accordance with an aspect of the present invention, a method of drying a material by passing a gas at least one of through and over the material, includes the steps of warming the material by maintaining the enthalpy substantially constant and by maintaining a minimal drying potential; and removing a first quantity of moisture from the material by increasing the drying potential from the level of the same utilized in the first step and by at least maintaining the former enthalpy level.

In accordance with another aspect of the present invention, a method of drying a material by passing a gas at least one of through and over the material, includes the steps of warming the material by maintaining the enthalpy substantially constant and by maintaining a minimal drying potential; removing a first quantity of moisture from the material by increasing the drying potential from the level of the same utilized in the previous step and by at least maintaining the former enthalpy level; and removing a second quantity of moisture from the material by increasing the drying potential from the level of the same utilized in the previous step and by varying the enthalpy in accordance with desired characteristics of the material.

In accordance with yet another aspect of the present invention, a method of drying a material having an initially heated layer, an opposite layer and at least one intermediate layer therebetween, by passing a gas at least one of through and over the material, includes the steps of warming the material by maintaining the enthalpy substantially constant and by maintaining a minimal drying potential; removing a first quantity of moisture from the material by increasing the drying potential from the level of the same utilized in the previous step and by at least maintaining the former enthalpy level; sequentially repeating the first two steps through each layer, in sequence, from the initially heated layer to the opposite layer; and removing a second quantity of moisture from the material by increasing the drying potential from the level of the same utilized in the previous step and by varying the enthalpy in accordance with desired characteristics of the material.

The above, and other, objects, features and advantages of the present invention will become readily apparent from the following detailed description thereof which is to be read in connection with the accompanying drawings.

BRIEF DESCRIPTION OF THE DRAWINGS

The FIGURE is a schematic view of apparatus for performing the method of drying according to the present invention.

DETAILED DESCRIPTION OF THE PREFERRED EMBODIMENTS

Before discussing a specific embodiment of the present invention, a brief review of some basic concepts will follow.

Specific enthalpy H is the quantity of recoverable energy available in a certain mass. Basically, specific enthalpy H is defined as follows:

$$H=U+PV \quad (1),$$

where U is the internal energy, P is pressure and V is volume. More particularly, specific enthalpy H can broken down into different components as follows:

$$H=H_a+gH_g \quad (2),$$

where H is the specific enthalpy of moist air per kilogram of dry air, $H_a$ is the specific enthalpy of dry air, $H_g$ is the specific enthalpy of water vapor, all measured in kJ/kg, and g is the moisture content per kilogram of dry air, measured in kg/kg.

In the present invention, the method of drying a material is used with a fixed pressure and volume. Since the internal energy U is a function of pressure and temperature, that is, U=f(P,T), from equations (1) and (2), the following are derived:

$$H_a=f(U,P,V)=f(P,V,T) \quad (3),$$

$$H_g=f'(U,P,V)=f'(P,V,T) \quad (4).$$

Combining equations (2), (3) and (4), the specific enthalpy of the system is derived as follows:

$$H=f''(H_a,H_g,g)=f''(P,V,T,g) \quad (5).$$

Since the present invention utilizes a constant pressure and volume, equation (5) is reduced as follows:

$$H=\text{constant}\times f''(g,T)(6) \quad (6).$$

From equation (6), it is readily seen that specific enthalpy H is a function of moisture content g and temperature T. It will be remembered that drying potential of air is also dependent on the moisture content and temperature of the air. However, the enthalpy and drying potential thereof vary differently, although depending on the same quantities, that is, temperature T and moisture content g. A simple example readily illustrates this concept. For example, saturated air at 10° C. has approximately the same enthalpy H as air at 20° C. and 25% humidity, since the air in both situations has the same heat content and the same potential for recoverable heat. However, the 10° C. air has no drying potential, since it is saturated, while the 25° C. air does have a drying potential. The values of enthalpy H as a function of temperature T and moisture content g are readily obtainable from prepared tables, such as those published in the "IHVE Guide, C1 & 2, Properties of Humid Air, Water and Steam", 1975, by The Institution of Heating and Ventilating Engineers, 49 Cadogan Square, London SW1XOJB, and printed by the Curwen Press Ltd., London E13.

The present invention utilizes these concepts to optimize the drying of a material by varying the specific enthalpy H and the drying potential independent of each other. Basically, the present invention uses the specific enthalpy as a governor, thereby maximizing the rate at which drying occurs. Practically speaking, during a first step, the present invention maintains the enthalpy substantially constant and maintains a minimal drying potential so as to warm the material without removing any moisture therefrom, or at least minimizing the moisture removed therefrom. Thereafter, after the material has been warmed, moisture is removed from the material by increasing the drying potential and at least maintaining the same enthalpy level. As a result, there is a substantially even drying throughout the material so that the aforementioned damage to the material is avoided. In effect, the material is first conditioned and then dried.

In accordance with the present invention, the values of specific enthalpy and drying potential are controlled by monitoring the temperature and moisture content of the drying air and adding heat and moisture, as required.

Referring to the FIGURE, an example of the present invention used for drying green malt will now be described in detail. Green malt is a material which is susceptible to damage if subjected to incremental changes in enthalpy and drying potential greater than predetermined values. For example, as aforementioned, if there is an ungoverned drying of the material, there will probably result a low alcohol conversion and undesirable coloring or scorching of the material. For the example of the drawing, it is assumed that the initial moisture content of the malt is 45% and it is an object to reduce the moisture content to approximately 4%. It is also assumed for this example that the ambient air initially has a temperature of 15° C. and a dew point of 10° C., although if the drying cycle continues into the night, the moisture content may drop to a dew point of 0° C., and the temperature, having also dropped to around 0° C. may typically recover to approximately 3° C. by morning.

In the present example, the method of drying will be described as comprising three distinct phases or steps, although, it is to be understood, in practice, that the phases may overlap at least to some extent.

In the drawing, a chamber 2 contains a quantity of material 4, such as green malt, to be dried. Air is passed through chamber 2 from an inlet 6 at the bottom B thereof by means of a fan 8, whereby the air passes through and over material 4 and is exhausted through an outlet 10 of chamber 2, where it is either vented to atmosphere at opening 12 or returned to fan 8 through a branch pipe 14 for recirculation. A valve 16 controls the proportion of air recirculated with respect to the proportion vented to atmosphere.

As the air is forced from fan 8 to inlet 6, it passes through a heater 18 which functions to heat the air. A mixing unit 20 is provided between heater 18 and inlet 6 for introducing moisture to the air in the form of steam or liquid water through a moisture inlet 22 controlled by a valve 24.

The rate of air flow produced by fan 8 is controlled by a controller 26. To the extent that insufficient air is recirculated to fan 8 through branch pipe 14, air is introduced through an inlet 28. The air introduced through inlet 28 will normally be moist ambient air but, in certain circumstances, may be relatively or absolutely dry air.

The temperature of the air circulating in the apparatus is determined at various positions by means of sensors T1, T2, T3 and T4. The moisture content of the circulating air is similarly determined at corresponding locations by moisture sensors M1, M2, M3 and M4. Preferably, a plurality of sensors T2 and M2 are placed within the green malt at different heights, for example, one set for every foot.

Temperature sensor T1 relays temperature information back to heater 18 for controlling the same, while the remaining temperature and moisture sensors relay information back to a controller 32 which, in turn, controls the temperature and moisture content of air passing through and over material 4 in chamber 2 by controlling valve 16, valve 24 and valve 30 to control the enthalpy and drying potential of the air passing through and over material 4, as will be described in greater detail hereinafter. Controller 32 may automatically perform the required controls, or may be manually controlled in response to the sensed moisture and temperature levels read from appropriate meters.

It will be appreciated that the mere supplying of heated air through inlet 6 will result in green malt at the bottom B of chamber 2 drying at a faster rate than the upper surfaces of green malt in chamber 2. This uneven drying may result in the aforementioned low alcohol conversion and high color content.

In accordance with the present invention, in the first step of the method, ambient air is drawn from inlet 28 through valve 30 by fan 8, heated in heating unit 18 and moistened as required in mixing unit 20 so as to produce air with a desired substantially constant enthalpy and a minimal drying potential, which is introduced into chamber 2 through inlet 6. As an example, a value of enthalpy in the range of 80–93 kJ/kg and a drying potential of 3 gm/kg is maintained.

It will be appreciated that the green malt heats up gradually, from the bottom of chamber 2 to the top thereof. This can be better understood by envisioning that material 4 is divided into different vertical strata or layers $L_1$ to $L_{10}$, as shown in the FIGURE. Basically, with the drying potential kept at a minimal level, the grain is gradually heated through each layer until the grain is uniformly heated to a substantially constant temperature. In actuality, some moisture is removed during heating of the first layer, and this moisture travels upwardly to the next layer where it condenses and is deposited therein. Since enthalpy is controlled and thereby acts as a governor on drying, the problem of drying too fast, as previously discussed in the background, does not occur. This process continues until all of the layers are uniformly heated, while maintaining substantially the same moisture content throughout the material as a whole. It will also be appreciated that, in actuality, there are no distinct layers within the grain, but that the warming of the green malt is a continuous process from the bottom to the top thereof. Thus, the green malt is warmed, and there is a transpiration of moisture within the material. The initial or first step therefore proceeds with gradual warming of the material without substantially changing the moisture content of the entire bed of green malt.

The control of specific enthalpy and drying potential is effected by controlling the moisture content and temperature of air entering chamber 2 by means of the sensors. Thus, the moisture introduced may originate from the atmosphere, any recirculated exhaust air or by injection into mixing unit 20, whereby the moisture of the input air is controlled by valves 16, 24 and 30.

The first step is continued until the conditions recorded by sensors M3 and T3 have reached predetermined values or until conditions in a predetermined zone within material 4, determined by sensors M2 and T2, have reached predetermined values.

The second step of the process is a free drying step where as much moisture as possible is removed from the material in the fastest time. In the second step, a first quantity of moisture is removed from the material by increasing the drying potential from the minimal drying potential in the first step and by at least maintaining the former enthalpy level, that is, maintaining it constant or increasing it. Whether to increase the level of enthalpy in the second step or maintain it at the same substantially constant level depends on the material being dried. For example, in the above example where green malt is to be dried, the enthalpy is increased to 130 kJ/kg and the drying potential is increased to 12 gm/kg.

As with the first step, in the second step, specific enthalpy and drying potential are independently controlled. For example, an increase in enthalpy H does not necessarily result in an increase in drying potential. This can be readily seen from the IHVE Guide Tables, in which, at saturation, specific enthalpy H is 29.35 KJ/Kg at 10° C. and 57.55 KJ/Kg at 20° C. Thus, drying potential has not increased, but specific enthalpy H has increased. Thus, specific enthalpy and drying potential are independently controlled.

It is noted that, if specific enthalpy H is decreased in the second step, while increasing the drying potential, there will result a cooling at a lower temperature, which is undesirable. In other words, there would effectively be a heating up and cooling down, which does not optimally utilize energy, and in fact, would be wasteful of energy. Thus, due to evaporative cooling, the material would not heat up further, and the free drying of the second step would be defeated.

During this second step, at least some of the exhaust air is recirculated through branch pipe 14, whereby the injection of moisture through valve 24 is accordingly adjusted. In exceptional circumstances, dry air will be introduced through inlet 28. During the second step of free drying, there is an evaporative cooling of the moisture from material 4. During the evaporative cooling, the temperature of the product does not rise to the value of the input air. Conversely, when the temperature of the product as measured by temperature sensored T2 begins to increase without any corresponding increase in the moisture content of the air in the material as determined by moisture sensor M2, the end of the second step of free drying is indicated. At this time, moisture cannot be removed at the same fast rate.

It will be appreciated that, in actuality, the first and part of the second step are continuously operative in sequence from the bottom B of chamber 2 to the upper surface S thereof. For ease in illustration, and assuming the different layers $L_1$–$L_{10}$, as shown, the material 4 in the lowermost layer $L_1$ is warmed by maintaining the enthalpy substantially constant and by maintaining a minimal drying potential. Then, when the material in the next layer $L_2$ is being warmed in accordance with the first step, the material in the lowermost layer $L_1$ has its moisture removed in accordance with the second step. Thereafter, when the material in the second layer $L_2$ has its moisture removed by the second step, the material in the third layer $L_3$ is being warmed in accordance with the first step, and so on, until the moisture from the material breaks through the upper surface S of the green malt.

In the third step of restrictive drying, moisture is removed at a restricted rate. For example, in this stage, the moisture content of the material may be 7% and, in order to reduce the moisture content to 4%, it is necessary to increase the drying potential of the air so as to shorten the process. This increase in drying potential can be effected, for example, by increasing the temperature of the circulating air by heater 18 while maintaining the same moisture content, maintaining the temperature and introducing dry air through inlet 28, thereby reducing the moisture content, varying the temperature, moisture content and flow rate of the circulating air by means of controller 26, or the like.

During the third step of restrictive drying, the enthalpy is varied in accordance with desired characteristics of the material, for example, whether it is desired for the grain to have a slightly brown color or the like.

It will be appreciated that, in the third step, much of the moisture from the material has already been evaporated, and accordingly, moisture is not as readily available for drying. Accordingly, to further reduce the moisture during the third step, there must be a consequent increase in the drying potential. As an example, the enthalpy in the third step can be selected as 125 kJ/kg and the drying potential as 23 gm/kg, relative to the previously mentioned values.

As an example of the time periods of each step in the above method of drying green malt, the first step of warming occurs for approximately two hours, followed by the second step of free drying for 10 hours, and followed by the third step of restrictive drying for 4–6 hours.

In the above example, although the three steps of operation have been described as being quite distinct from each other, in practice, the free drying phase is somewhat integrated with the warming phase, as clearly illustrated with respect to the different layers of heating of the grain. However, for each phase, the specific enthalpy and drying potential of the air will be controlled independently of each other. Of course, it will be further appreciated that, if the second step of free drying continues to a point at which the moisture content of the material is reduced to the desired level, the third phase can be dispensed with.

In the above example, a batch drying operation was discussed wherein the three drying phases occurred in the same space, but at different periods of time. The invention, however, is equally applicable to a continuous processing operation in which a material is subject to the first step of warming in a first zone, and the material is then moved successively to second and third zones for removing moisture in accordance with the second and third steps, respectively.

As an example, if paper is to be dried to a desired moisture content, a continuous processing operation can be used. The paper in the continuous processing operation preferably passes through successive zones at a fixed flow rate. In the first zone, the enthalpy is 290 kJ/kg with a drying potential of 30 gm/kg of dry air. In a first part of the first zone, for example, the moisture content of the paper is 60% and is not reduced since there is a minimal drying potential with the enthalpy being maintained substantially constant.

The second step is performed as the paper continues moving through the remainder of the first zone, and as it moves through a second zone. In the remainder of the first zone, the moisture content of the paper is reduced to 30%. As the paper is then moved to a second zone, moisture content is further reduced, for example, from 30% to 15%. In the second zone, the second step of removing moisture from the material is performed in which the drying potential is increased to 55 gm/kg, while the enthalpy is maintained substantially constant at 290 kJ/kg. It will be appreciated that, if the enthalpy drops in the second step, air must be blown in, whereby energy would be input into the system, and the total enthalp would remain substantially constant.

Thereafter, the paper is moved to a third zone where the third step of removing a second quantity of moisture from the material is performed, for example, for reducing the moisture content from 15% to 2.5%. During the third step, the drying potential is further increased to 70 gm/kg, while the enthalpy is reduced to 250 kJ/kg.

Generally, after the moisture content is reduced to 2.5%, some fine papers may be passed through sizing apparatus. During sizing of the paper, the moisture content, however, increases, for example, to 20%. It is therefore necessary to perform still an additional drying step, for example, where the drying potential is 60 gm/kg and the enthalpy is 230 kJ/kg, and the moisture content of the paper is reduced to 5%.

Although the present invention has been described primarily in regard to the drying of grains and paper, it is equally applicable to other products.

Having described specific preferred embodiments of the invention with reference to the accompanying drawings, it is to be appreciated that the present invention is not limited to those precise embodiments, and that various changes and modifications may be effected therein by one of ordinary skill in the art without departing from the scope or spirit of the invention as defined by the appended claims.

I claim:

1. A method of drying a material by passing a gas at least one of through and over said material, comprising the steps of:

(a) warming said material by maintaining the enthalpy substantially constant and by maintaining a minimal drying potential; and (b) removing a first quantity of moisture from said material by increasing the drying potential from the level of the same utilized in Step (a) and by at least maintaining the former enthalpy level.

2. A method of drying according to claim 1; wherein said step of warming includes the steps of monitoring temperature and moisture content of said gas at different positions with respect to said material, and varying the moisture content of and adding heat to said gas in response to said sensed temperatures and moisture contents.

3. A method according to claim 2; wherein said step of varying the moisture content of said gas includes at least one of a step of recirculating said gas, adding gas from an external source and adding moisture to said gas from a source of moisture.

4. A method according to claim 2; wherein said step of adding heat to said gas includes a step of increasing the temperature of said gas by at least one of a heater, recirculating said gas and adding gas from an external source.

5. A method according to claim 1; wherein said step of removing a first quantity of moisture includes the steps of monitoring temperature and moisture content of said gas at different positions with respect to said material, and varying the moisture content of and adding heat to said gas in response to said sensed temperatures and moisture contents.

6. A method according to claim 5; wherein said step of varying the moisture content of said gas includes at least one of a step of recirculating said gas, adding gas from an external source and adding moisture to said gas from a source of moisture.

7. A method according to claim 5; wherein said step of adding heat to said gas includes a step of increasing the temperature of said gas by at least one of a heater, recirculating said gas and adding gas from an external source.

8. A method of drying a material by passing a gas at least one of through and over said material, comprising the steps of:

(a) warming said material by maintaining the enthalpy substantially constant and by maintaining a minimal drying potential of said gas;

(b) removing a first quantity of moisture from said material by increasing the drying potential from the level of the same utilized in Step (a) and by at least maintaining the former enthalpy level; and (c) removing a second quantity of moisture from said material by increasing the drying potential from the level of the same utilized in Step (b) and by varying the enthalpy in accordance with desired characteristics of the material.

9. A method of drying a material having an initially heated layer, an opposite layer and intermediate layers therebetween by passing a gas at least one of through and over said material, comprising the steps of:

(a) warming said material by maintaining the enthalpy substantially constant and by maintaining a minimal drying potential of said gas;

(b) removing a first quantity of moisture from said material by increasing the drying potential from the level of the same utilized in Step (a) and at least maintaining the former enthalpy level;

(c) sequentially repeating Steps (a) and (b) through each layer, in sequence, from the initially heated layer to the opposite layer; and (d) removing a second quantity of moisture from said material by increasing the drying potential from the level of the same utilized in Step (c) and by varying the enthalpy in accordance with desired characteristics of the material.

10. A method of drying according to claim 9; wherein said initially heated layer is a bottom layer and said opposite layer is a top layer of said material.

* * * * *